United States Patent [19]

Inoue

[11] Patent Number: 4,591,695

[45] Date of Patent: May 27, 1986

[54] ROTATABLE BARREL CURLING IRON

[76] Inventor: Taro Inoue, 3-5-20, Kitagata, Okayama, Japan

[21] Appl. No.: 611,890

[22] Filed: May 18, 1984

[51] Int. Cl.[4] ..... H05B 3/00; A45D 1/04

[52] U.S. Cl. ..... 219/225; 132/9; 132/34 R; 132/37 R; 219/230

[58] Field of Search ..... 219/222-226, 219/230; 132/9, 31 R, 32 R, 34 R, 37 R

[56] References Cited

U.S. PATENT DOCUMENTS

| | | | |
|---|---|---|---|
| 546,031 | 9/1895 | Schoonmaker | 132/34 R |
| 687,819 | 12/1901 | Crandall | 132/34 R |
| 1,820,498 | 8/1931 | Rowley | 132/34 R |
| 1,845,208 | 2/1932 | Tankins | 132/32 R |
| 1,857,689 | 5/1932 | Melkman | 219/225 X |
| 2,062,561 | 12/1936 | De Lado | 132/31 R |
| 4,211,914 | 7/1980 | Jackson | 219/225 |
| 4,267,431 | 5/1981 | Rick et al. | 219/225 |
| 4,442,849 | 4/1984 | Kawabe | 132/37 R |

*Primary Examiner*—A. Bartis

*Attorney, Agent, or Firm*—Koda and Androlia

[57] ABSTRACT

A curling iron comprising a barrel rotatably supported on a grip portion and a clamping tongue which are assembled in a form similar to a pair of scissors so that the tongue makes pivotal movements relative to the barrel. The barrel, which is rotatable relative to the grip portion, encloses an electric heater in it and is designed to rotate in the direction opposite to the rotational direction of the grip portion of the curling iron by means of suitable gears provided between the barrel and the grip portion. The clamping tongue mounted onto the iron body may be formed with rollers arranged in arc form or with a plate bent in an arc. With such a structure, the hair held between the barrel and the tongue is curled from the root to the end by turning the grip portion which turns the barrel in the opposite direction of the handle turning direction by means of gears.

1 Claim, 8 Drawing Figures

Fig. 5
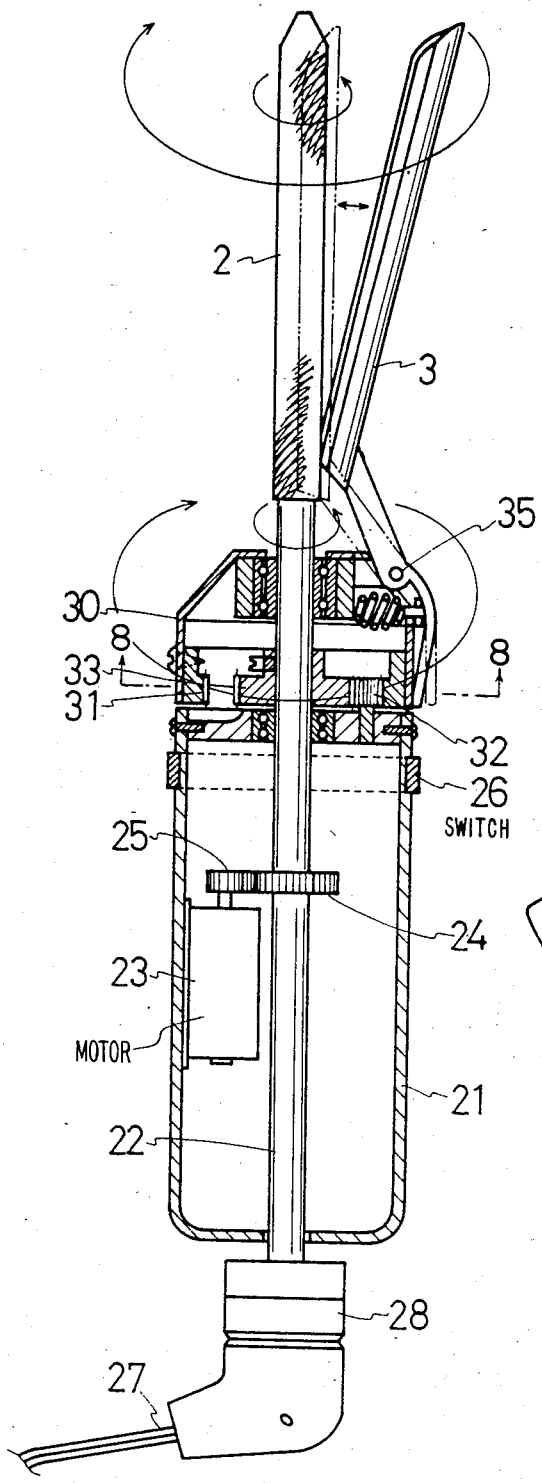
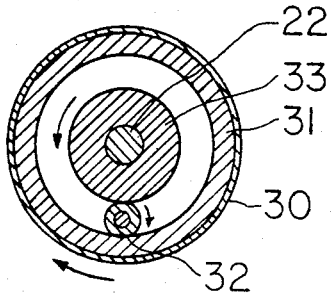
Fig. 8
Fig. 6
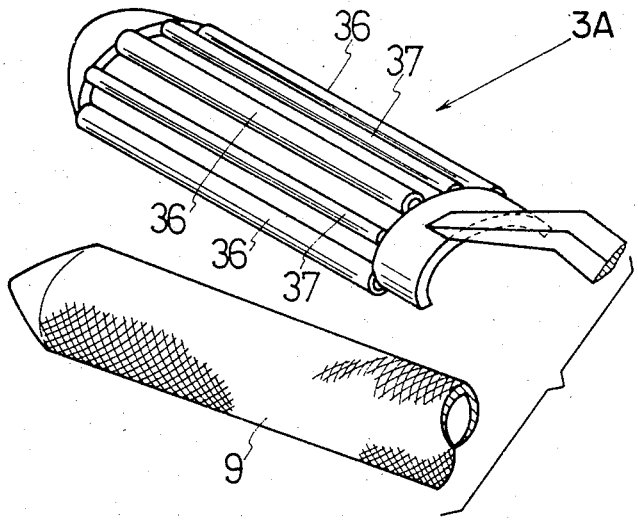

ROTATABLE BARREL CURLING IRON

BACKGROUND OF THE INVENTION

1. Field of the Invention

This invention relates to hair curling irons, and more particularly to hair curling irons used for forming curls and waves.

2. Prior Art

Curling irons are designed to form curls and waves in hair by ironing it from the root to the end while holding a section of the hair clamped between a barrel and a tongue.

Conventional curling irons of this type have been provided with a structure wherein a fixed barrel and clamping tongue are assembled to make pivotal movements similar to a pair of scissors. However, they serve to only partially curl hair by heating each lock of hair with a heater built in the fixed barrel. Up to now, there have been no curling irons which wind up long hair into a curly style with simple operation.

SUMMARY OF THE INVENTION

The curling iron provided by this invention is developed with a primary object of using it for curling long hair.

In order to accomplish the object, the curling iron of this invention has a unique structure. While conventional curling irons have a barrel with a heater built in it and a clamping tongue mounted onto an iron body in a scissors-like form, the barrel of the curling iron according to this invention is designed to rotate, and its rotational direction is opposite to the rotational direction of the clamping tongue.

With such a structure, the curling iron according to this invention is able to curl long hair evenly from the root to the end without holding the hair tightly between the barrel and clamping tongue even when the hair is rolled onto the iron five to six times in the curling process.

BRIEF DESCRIPTION OF THE DRAWINGS

FIG. 5 is a partially cutaway view of another electric iron according to this invention;

FIG. 6 is a perspective view of a third embodiment of the clamping tongue;

FIG. 8 is a sectional view of FIG. 5 similar to FIG. 2.

DETAILED DESCRIPTION OF THE INVENTION

Figure 1:
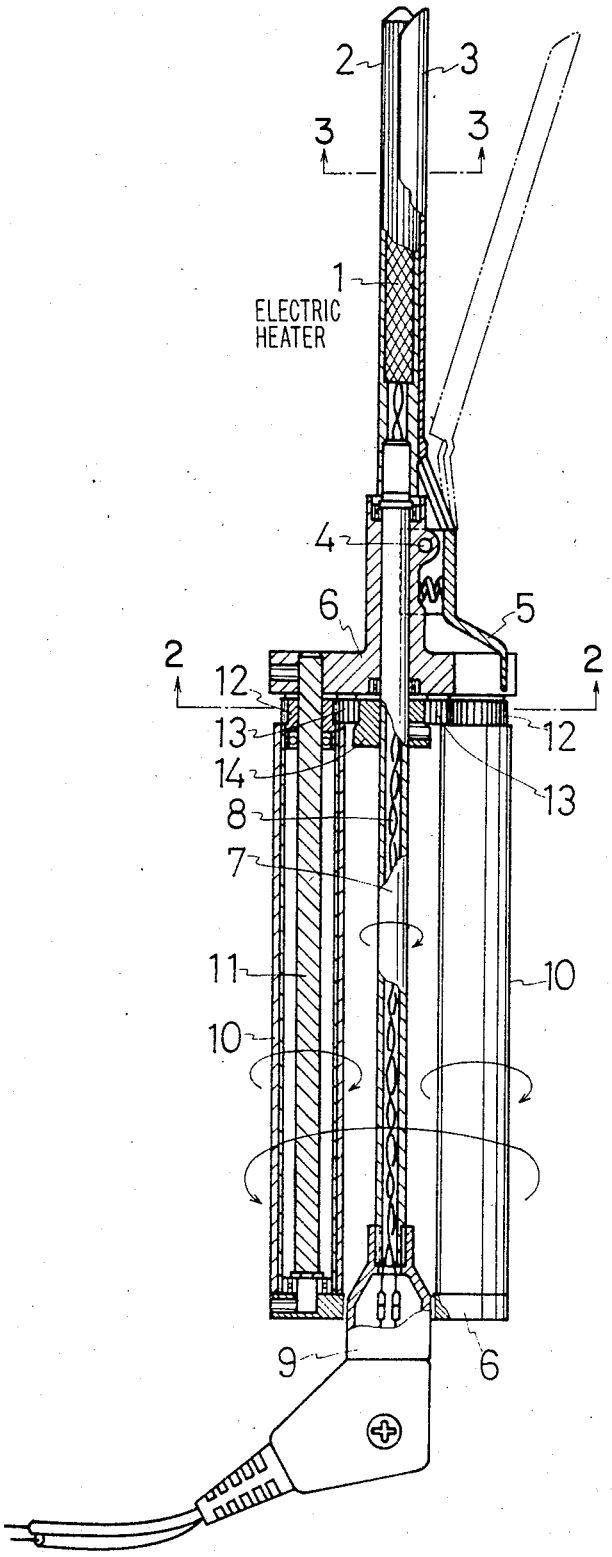
FIG. 1 is a partially cutaway view of an embodiment of a curling iron according to the teachings of the present invention.
Figure 2:
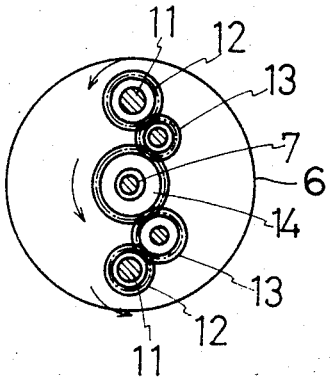
FIG. 2 is a sectional view taken along the line 2—2 in FIG. 1.
Figure 3:
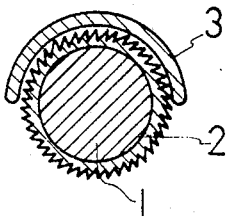
FIG. 3 is an enlarged sectional view taken along the line 3—3 in FIG. 1.

Shown in FIG. 1 is a hand operated curling iron. A barrel 2 has a heater 1 built in it. A clamping tongue 3 is pivotally mounted onto one of a pair of spaced apart holders to which are secured together by shaft members 11 to form a handle structure by means of an axle 4 so that the tongue 3 is movable and rests on the barrel 2 in a like manner to form a scissors-like assembly. The clamping tongue 3 opens as indicated by the two-dot chain line when a lever 5 formed at its rear part is pressed down. The barrel 2 is fixed to a center shaft 7 which is supported by holders 6 and 6 in a freely rotatable manner. Extending through the center shaft 7 is an electric cord 8 and the end of the center shaft 7 is formed to be a connector 9 which is freely rotatable within holders 6. A pair of gripping portions 10 provided between the holders 6 and 6 are cylindrical in form so as to be easily gripped. In this embodiment, the two gripping portions 10 and 10 are on the right and left sides of the shaft 7. The gripping portions 10 themselves are each rotatably supported on supporting shafts 11 which are provided on both the right and left sides of the center shaft 7 through suitable bearings provided at the upper and lower ends of the supporting shafts 11, respectively. On the upper end of each gripping portion 10, a gear 12 is mounted. This gear 12 engages with a large diameter gear 14 on the center shaft 7. This engagement of the gear 12 with the large diameter gear 14 is effected through an intermediate gear 13. In this case, the gear 12 mounted onto the rotary gripping portion 10 is smaller in diameter than the large diameter gear 14 of the shaft 7. Therefore, gripping portions 10 are adapted to rotate the center shaft 7 through the gear 12 on the end of each gripping portion 10 drivingly engageable with a gear 14 on the end of shaft 7 through the intermediate gear 13 as shown in FIGS. 1 and 2.

With such a structure, when the curling iron is rotated once, the barrel 2 together with the tongue 3 also makes a number of rotations determined by the ratio of gear 12 to gear 14. When the rotational ratio between the gripping portion 10 and the barrel 1 is smaller, the diameter of the hair curl becomes smaller. When such a ratio is set larger, the diameter of the hair curl becomes larger forming a gently curved curl. The rotational ratio can be increased or decreased by changing the gear ratio between gears 12 and 14.

As has been described above, in the curling iron provided by this invention, the barrel is not rigidly fixed but is rotatably supported and rotatable in the direction opposite to the rotational direction of the holders 6 and tongue 3 by the cooperation of the gears 12, 13 and 14. Therefore, as will be described later, during the rolling up of the hair, no tension is applied to any point of the hair all through its length. Thus, more graceful curling is effected quite naturally with a satisfactory result.

Shown in FIG. 5 is an electric curling iron. This curling iron lessens the labor of the operator, and also enables an unskilled operator to form curls and waves as good as those formed by a skilled operator.

This curling iron is structured as follows. In a cylindrical case 21, a center shaft 22 is inserted along the longitudinal direction, all through the length of the cylindrical case 21. Gears 24 and 25 are meshed with each other so that a motor 23 rotates the shaft 22. The motor 23 is turned ON and OFF and changes its rotational speed by a ring-form sliding switch 26 mounted on the case 21. The root part of the center shaft 22 is fit with a connector 28 and comes into contact with a power cord 27 in a rotational manner. Through this connector 28, the electricity is conducted to a heater which is mounted in the barrel 2. The heater thus generates heat.

The top of the case 21 is capped with a head casing 30. The internal circumference of this head casing 30 is formed with an internal gear 31. This internal gear 31 is engaged with a gear 33 mounted on the center shaft 22. The engagement of the internal gear 31 with the gear 33 is effected through an intermediate gear 32. This gear 32 is held axially by the top portion of the case 21. Therefore, when the center shaft 22 and the barrel 2 are rotated, the head casing 30 rotates in the opposite direction. In this case, the rotational ratio is determined by the gear ratio between the gear 33 and the internal gear 31. The base of a clamping tongue 3 is mounted on the head casing 30 at fulcrum 35. Thus, when the head casing 30 rotates, the clamping tongue 3 also rotates.

Figure 4:
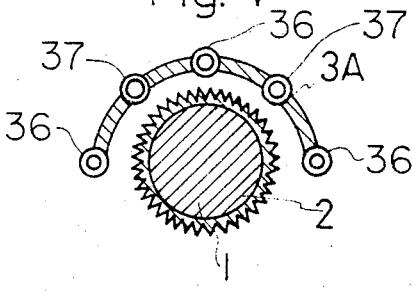
FIG. 4 is a sectional view of the embodiment of the invention illustrated in FIG. 6.

FIGS. 4 and 6 shows another example of the structure of the clamping tongue 3A. In this example, two or more rollers are arranged in arc form along the axial direction of the rod. When compared to the arc-shaped plate clamping tongue, this roller type tongue greatly reduces resistance of the hair. The rotation of the handle is thus made very easy. Furthermore, the roller type tongue lessens tension in the hair caused by pulling, and reduces damage to the hair. The clamping tongue 3A shown in FIG. 6 is semi-cylindrical in shape and includes three rotary rollers 36 and two connecting rods 37 disposed on it alternately.

The curling iron of this invention is operated as follows.

Figure 7:
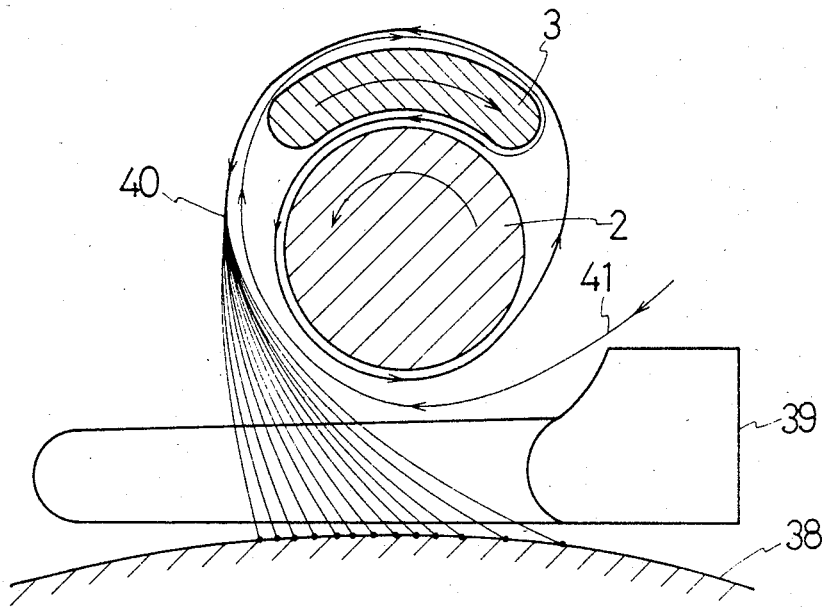
FIG. 7 is a diagram showing hair rolled onto the curling iron.

In FIG. 7, first, a comb 39 is used for holding a lock of hair within a given width by bringing the comb 39 into contact with the scalp 38. With the comb 39, the lock of hair is combed through to the end. Then, the root portion 40 of the parted hair is inserted between the barrel 2 and the clamping tongue 3. In the case of curling with the curling iron shown in FIG. 1, the two handles are rotated while constantly kept tightly in contact with the inner surfaces of the fingers and palm. By means of the rotary gear group, the barrel is rotated in the direction reverse to the rotational direction of the clamping tongue (that is, the rotational direction of the handle structure comprising holders 6 and shafts 11). As a result, the long hair is rolled into a large curl with a gentle curve without causing unnatural strain.

In such a state of curling operation, while the clamping tongue and the barrel rotate once as a whole, the hair with the additional length proportional to the rotational ratio of the reverse rotation of the barrel alone is drawn into the iron for curling. Thus, around the outer circumference of the barrel and the clamping tongue is formed a gently curved curl with the size larger than the length of the combined outer circumference of the rod and the clamping tongue. This way, while the portion of the hair closer to the end is drawn into the iron by the rotation of the entire body of the iron, the portion closer to the root that is already inserted between the barrel and the clamping tongue is positively sent out into the curled hair, due to the reverse rotation of the barrel. Consequently, without tightly pressing the barrel and clamping tongue from the outer circumference, the hair that is rolled first onto the outside of the barrel and the clamping tongue in sequence is drawn to the inside of the iron continuously in the order from the root portion to the end portion.

FIG. 7 illustrates an aspect of hair curling provided by using the curling iron of this invention. In the case shown in this Figure, the clamping tongue 3 is rotated in a clockwise direction by rotation of the handle structure comprising holders 6 connected by shafts 11, and, at the same time, as seen from FIGS. 1 and 5, the barrel 2 is rotated in the reverse direction. Accordingly, the barrel 2 turns counterclockwise as indicated by the arrow. Even though the hair closer to the root 40 is held between the barrel and the clamping tongue 3, the hair closer to the end 41 is forcibly drawn in by the rotation of the barrel 2. This way, heat is applied to the hair one portion after another and curled gently in such a state as floating toward the outside without pressing the clamping tongue. As a result, the entire length of long hair is set by heat naturally and securely from the root to the end without causing any resistance to the coiling action. In the Figure, the thick curved line from the scalp represents the hair which has been set curly by the curling iron and the fine curved line shows the hair that is to be rolled into the curling iron.

The structure of the curling iron of this invention is as described in detail above. Therefore, the barrel is rotated against clamping tongue, through operating by hand or with an electric motor. Also, the rotational direction of the barrel is opposite to that of the clamping tongue. Thus, through adjusting the rotational ratio, the optimum operation for curling from the hair root to the end can be performed by using this curling iron.

I claim:

1. A curling iron comprising:

an elongated handle structure having a central axis, said handle structure comprising:

a pair of spaced apart holders;

a pair of spaced apart shafts coupling said holders together;

a central shaft provided along said central axis and between said shafts, said central shaft being freely rotatably supported in said holders;

two gripping portions, said gripping portions being supported on respective ones of said pair of shafts for free rotation thereabout; and gear means provided between the gripping portions and said central shaft, said gear means being arranged and configured to drivingly rotate said central shaft in a same direction of rotation as the direction of rotation of said two gripping portions about said pair of shafts;

a barrel coupled to said central shaft for rotation therewith relative to said handle structure;

a heater provided in said barrel for heating said barrel to a curling temperature;

a clampling tongue pivotally coupled to said handle structure for movement toward and away from said barrel; and means for selectively pivotally moving the tongue relative to said barrel;

whereby when said curling iron handle structure as a whole is rotated in one direction, said barrel rotates in an opposite direction.

* * * * *